United States Patent [19]

Li et al.

[11] 4,019,509

[45] Apr. 26, 1977

[54] SELF-RESCUE BREATHING APPARATUS

[75] Inventors: Yi-Sheng Li, San Mateo; Rudolph Cesar Leon, Sr., Cupertino; Eugene Norman Perry, Sunnyvale, all of Calif.

[73] Assignee: Lockheed Missiles & Space Company, Inc., Sunnyvale, Calif.

[22] Filed: Aug. 28, 1975

[21] Appl. No.: 608,723

[52] U.S. Cl. ..... 128/147; 128/142 R; 128/191 R; 55/DIG. 17; 55/DIG. 35; 55/516; 55/309

[51] Int. Cl.[2] ..... A62B 7/08

[58] Field of Search ..... 128/191 R, 142 R, 142.2, 128/142.6, 147, 202, 203; 55/DIG. 17, DIG. 35, 421, 424, 355, 516, 518, 309; 23/281

[56] References Cited

UNITED STATES PATENTS

| | | | |
|---|---|---|---|
| 3,403,981 | 10/1968 | Lemcke et al. | 128/191 R |
| 3,707,965 | 1/1973 | Guzay | 128/142.6 |
| 3,942,524 | 3/1976 | Li et al. | 128/191 R |

FOREIGN PATENTS OR APPLICATIONS

| | | | |
|---|---|---|---|
| 305,185 | 11/1920 | Germany | 128/191 R |
| 309,238 | 12/1917 | Germany | 128/191 R |
| 192,633 | 8/1967 | U.S.S.R. | 128/191 R |

*Primary Examiner*—Robert W. Michell
*Assistant Examiner*—Henry J. Recla
*Attorney, Agent, or Firm*—Rodger N. Alleman; Billy G. Corber

[57] ABSTRACT

An impact resistant external casing is provided to enclose a canister containing a multi-layered chemical bed, with by-passes in each layer to accommodate the flow across and through the bed of exhaled breath which reacts with potassium superoxide in tablet form, the casing being provided with a (top) lid section which contains a mouthpiece, breathing hoses, and neck straps, the opposite side of the casing being provided with a bottom cover which accommodates the storage of a folded breathing bag and chest straps. An air passageway constituting an annular section is provided to accommodate a chimney extending from the bag through the passageway section between the casing and the canister, which is open to ambient air for cooling purposes. The inside bottom portion of the canister is provided with a trammel to prevent escape of deliquesced $KO_2$, and the breathing bag is characterized by having a single baffle, forcing air through the bag in such manner as to take the air as far from the heat of the canister as is possible. The case is provided with a moisture indicator which functions to indicate the presence of moisture, and therefore warn of any leaks that may have occurred in the case and, through the mouthpiece into canister which would cause premature reaction of the $KO_2$ and render it unsuitable for use.

11 Claims, 13 Drawing Figures

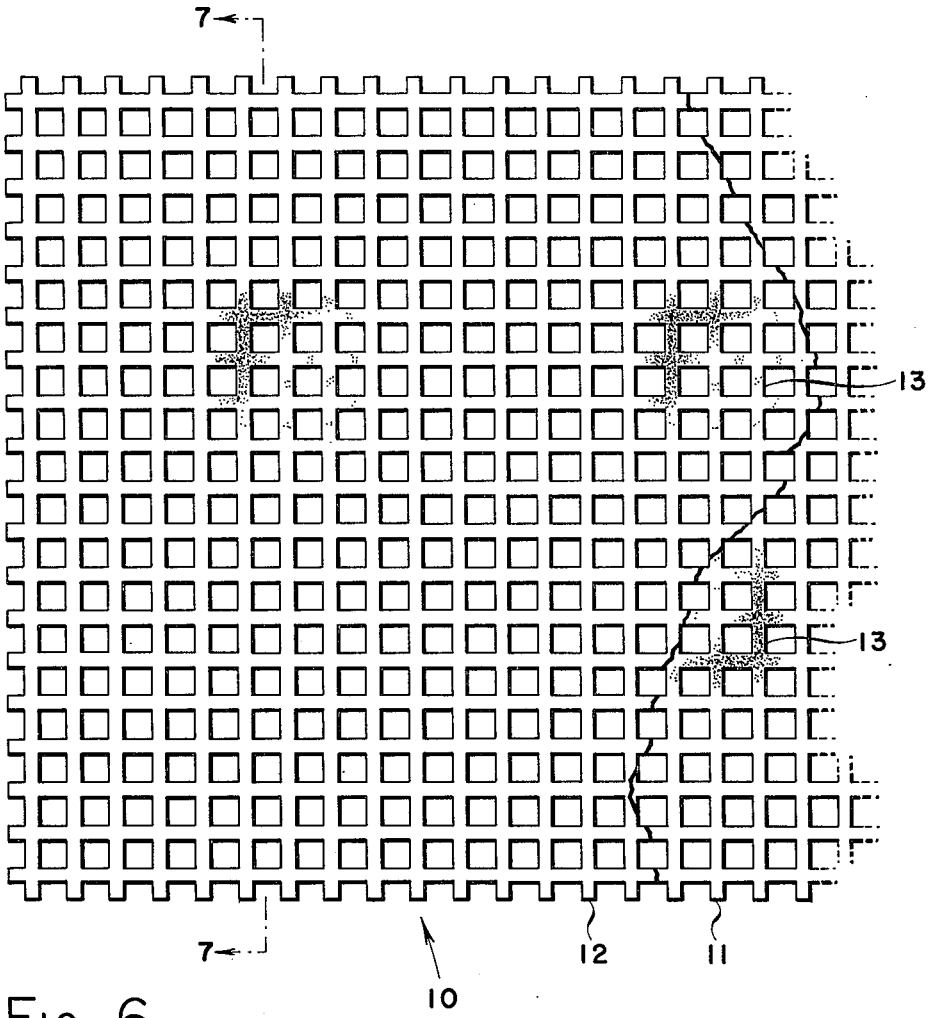
FIG. 6
FIG. 7
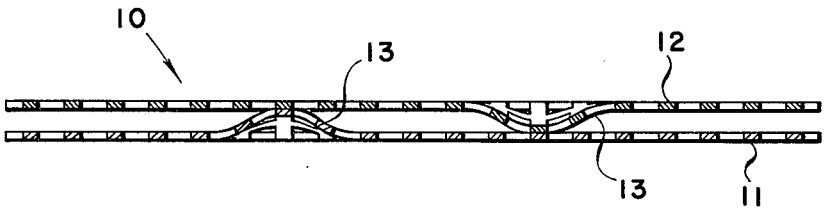

SELF-RESCUE BREATHING APPARATUS

BACKGROUND

Of the 529 coal miners killed in major mine disasters between 1951 and 1969 at least 88 died as a result of breathing irrespirable or toxic gas. At present, the only protection from such gases which the coal miner carries is a filter respirator which catalytically converts carbon monoxide to less toxic carbon dioxide. This device is not reliable in carbon monoxide concentrations greater than 2 percent and affords no protection against oxygen-deficient or toxic atmospheres.

A self-contained breathing apparatus which is small and light enough to be kept on or about the miner's person, as is the present carbon monoxide filter respirator, would greatly increase a miner's chance of survival after a fire or explosion. At present, there is no personal breathing apparatus of suitable size and wieght available which is approved by the U.S. Bureau of Mines.

The 1969 Coal Act requires that "each miner shall be provided with a self-rescue device adequate to protect such miner for one hour or longer." The Sunshine Mine disaster in 1972 in which 91 men were killed due to suffocation by smoke or carbon monoxide, reemphasized the need for newer, more reliable self-contained breathing apparatus.

Minimum requirements for a personal breathing apparatus are that it be (1) usable in toxic and oxygen deficient atmospheres, (2) be activated rapidly, and (3) furnish a minimum of 1 hour of breathable oxygen even though the person wearing the apparatus is under considerable mental and physical stress and thus may require higher than normal amounts of oxygen. The device should have a 5-year shelf life and a 3-year service life and be light enough to be included as a part of the equipment normally carried by the worker, rather than requiring him to locate and rush to the nearest storage of breathers located at scattered locations throughout a work area. Desirably, the breather device should not be a filter respirator, should provide its own source of oxygen that will remove the carbon dioxide and water contained in exhaled breath and should furnish a breathable mixture of oxygen.

PRIOR ART

Though the use of potassium superoxide in prior art devices has previously been noted, breather devices utilizing this material have not to the present been practical. Tabletized $KO_2$ of the type available from La Spirotechnique, Levallois-Perret, France, has been found to be desirable and advantageous in connection with such a breather device, the tabletized form of $KO_2$ holding advantages over the granular form because of its uniform size, greater resistance to crushing, more even density and porosity, higher utilization factor and less tendency to "dust."

Prior art of which applicant is aware is exemplified in U.S. Pat. No. 1,213,160 on a "Breathing Bag" issued to Davis, U.S. Pat. No. 2,913,317 on an "Oxygen Producing Canister" issued to Bovard, U.S. Pat. No. 2,469,367 on a "Canister and Distributor Therefor" issued to Burgess et al, U.S. Pat. No. 2,517,209 on an "Oxygen Liberating Canister" issued to Jackson et al, U.S. Pat. No. 3,403,981 on an "Oxygen Producing Canister" issued to Lemcke et al, and U.S. Pat. No. 3,575,167 on a "Multipurpose Breathing Apparatus" issued to Michielson.

None of the prior art devices have furnished sufficient amounts of oxygen (a function of the length of time oxygen would be available), combined with lightweight and low cost, along with high reliability over the life of the device.

There are a number of features of the present invention which enable it to perform in a superior manner while accomplishing the desired objectives and eliminating the problems of prior art devices. These features include: the utilization of $KO_2$ in tabletized form; in a series of layers through which exhaled breath may pass; with each of the layers of chemical being provided with a by-pass passageway to aid in the distribution of breath, and consequently the activation of the $Ko_2$, in various parts of the chemical bed layer. This results in elimination of problems where $KO_2$ would react near the inlet in such manner as to clog the device and shorten its operation while leaving unreacted $KO_2$ otherwise available for use. The thickness of the layers compared to their surface area in cross section, and the by-pass passages operate to provide a highly effecient chemical bed for reaction with moisture and carbon dioxide in the exhaled breath of the user. Prior to exiting into the breather bag, the flow path of gas passes through a trammel assembly. This trammel constitutes a "well" in the bottom of the canister, and a duct extending from one side of the canister and having its inlet near the center of the canister which operates to provide a safety feature against the inflow of deliquesced $KO_2$ into the breather bag. The breather bag is made of material which is essentially non-reactive to $KO_2$, yet which is lightweight and low cost, and provides a relatively nontortuous, cooling path for air passing through from the canister. An air passageway between the canister, which is relatively hot, and the walls of the casing which contain the canister is provided so that an ambient flow of cooling air is provided around a chimney member which connects the outlet of the breathing bag with a transition boot on the top of the canister and the inhalation hose leading to the mouthpiece of the user. The casing which secures the portions of the device together may be secured in any manner known in the prior art such as by vacuum sealing, or straps surrounding the casing.

In accordance with the above, it is an object of the invention to provide a lightweight breathing apparatus which may be carried by individuals exposed to hazardous situations which will be relatively low in cost and which will provide a device with a long service life which may be depended upon for rapid activation in the event of an emergency.

A further object of the invention is to provide a personal emergency breathing apparatus which utilizes the superior characteristics of tabletized potassium superoxide and which provides an environment in which the $KO_1$ or reaction product therefrom is prevented from escaping from the canister or entering the flow path of breathable air.

A further object of this invention is to provide a personal breathing apparatus which operates at a low enough temperature to be comfortable and acceptable to the user and which will not add distress and discomfort which would normally be attendant in a situation of use.

A further object of the invention is to provide a chemical bed layer which offers little resistance to the flow of breathable air passing therethrough and which efficiently and effectively allows a very high percentage of potassium superoxide chemical to be reacted with exhaled breath thus furnishing a breather of relatively long use life extending for a minimum of 1 hour and for as long as 4 hours or more in use. By scaling the bed size, ratios, and dimensions we can provide a source of breathable air that will last for periods as short as 10 minutes to more than 72 hours.

DRAWINGS

With these and other objects in mind the invention will now be more particularly described with reference to the attached drawings wherein the indicated numerals refer to like parts throughout the figures and in which:

FIG. 6 is a plan view of a typical screen assembly used to separate layers of chemical bed.

FIG. 7 is an end view and cross section of FIG. 6 taken along line 7—7 thereof.

DESCRIPTION OF THE PREFERRED EMBODIMENTS

Figure 1:
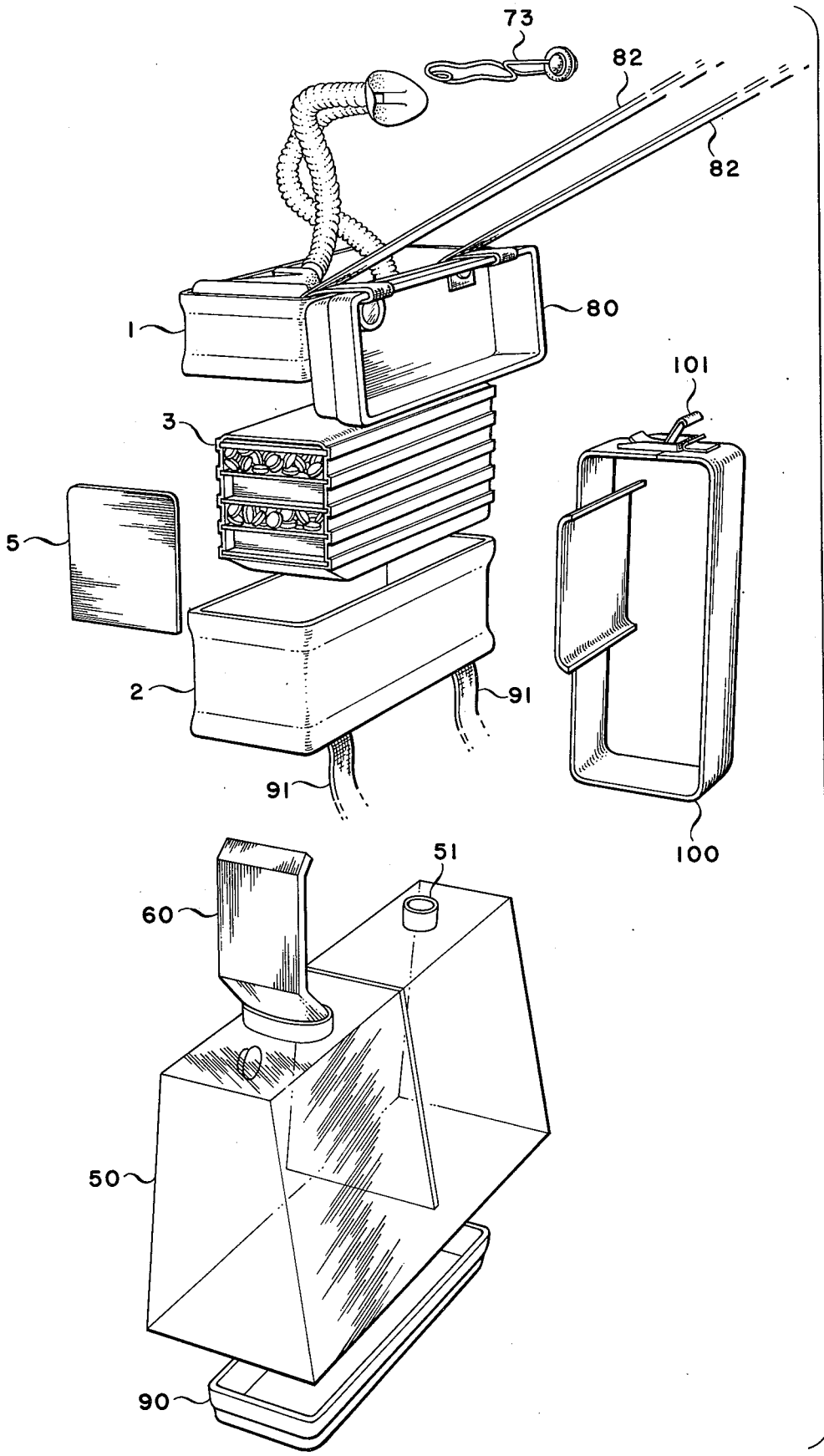
FIG. 1 is an exploded pictorial isometric view showing general placement and component parts of the personal breathing apparatus of the invention.
Figure 5:
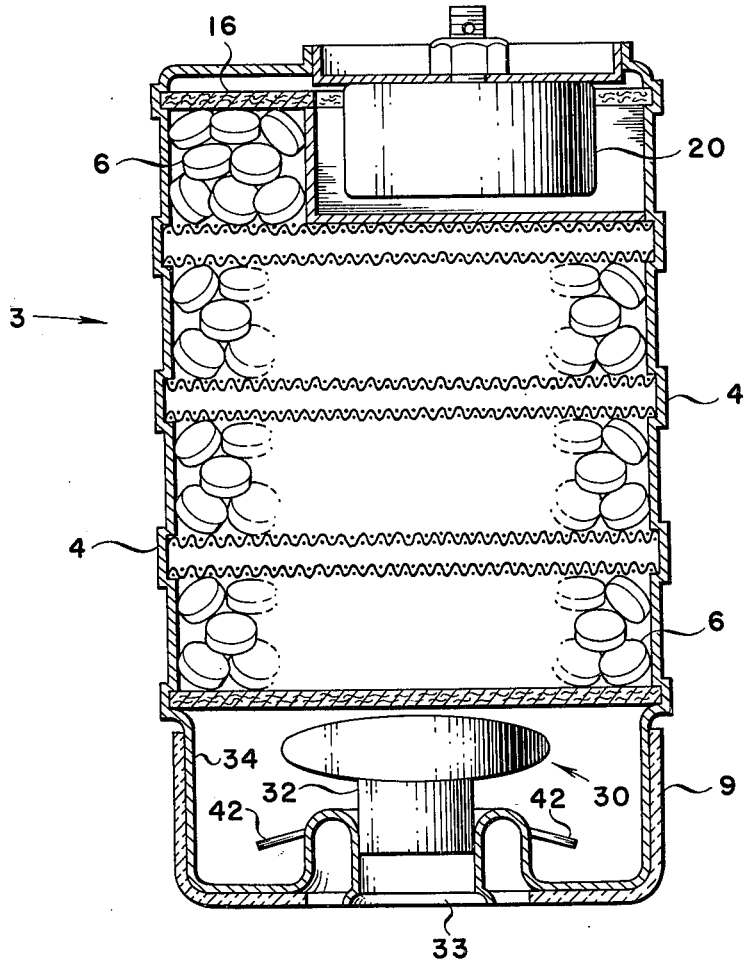
FIG. 5 is a view of the canister taken along line 5—5 of FIG. 3 showing an end view of the trammel, duct, chemical layer separation screens, and position of the starting candle.
Figure 4:
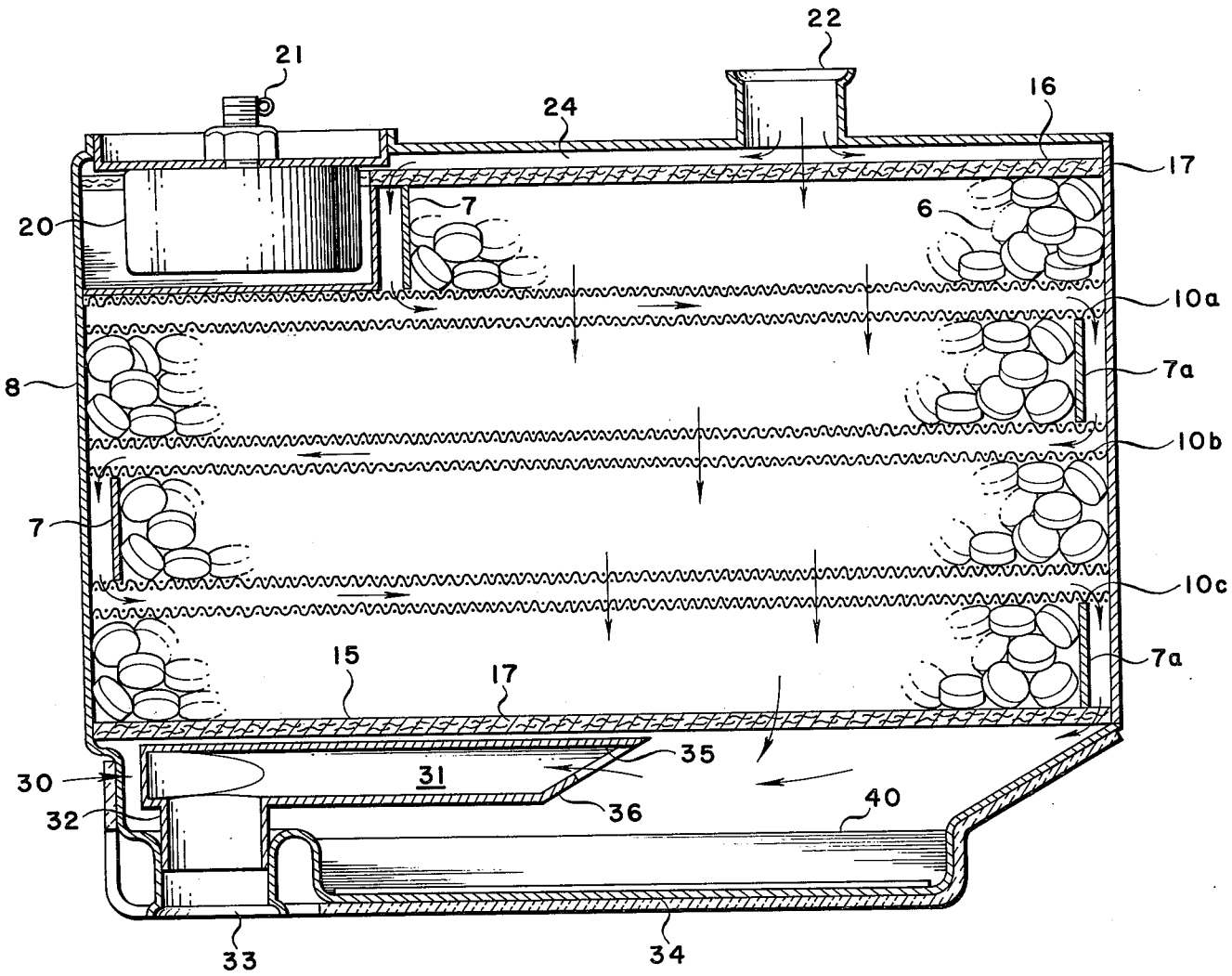
FIG. 4 is a view in cross-section of the canister taken along line 4—4 of FIG. 3.

With reference to the drawings as listed above, a detailed description of the invention is presented with reference first to FIG. 1 in which the exploded view of the assembly is shown to be comprised of upper and lower casings 1 and 2, respectively, constituting a central portion of a housing which contains a canister generally indicated at 3, it being noted that said canister is preferably electro-formed or otherwise integrally formed so as to present a unit which may be easily sealed from ambient elements. Canister 3 is preferably provided with a series of indentations 4 which furnish linear channels into which pairs of screens generally designated at 10 as shown in FIG. 7 may be introduced to provide descrete layers for potassium superoxide which is shown in FIGS. 4 and 5 to be in the form of tablets 6. It is noted that screen assemblies 10 are preferably dual screens as shown in FIG. 7 at 11 and 12 which are spaced one from another by means of staggered embossments 13, which embossments extend toward each other and furnish a proper spacing between the screens so as to hold the pairs in any given screen assembly at a proper distance to allow the passage of gas when the screens are assembled in the canister in the manner to be hereinafter explained.

As shown in FIG. 1, canister 3 is provided with an open end portion which is adapted to be closed by end cap 5 after the canister is assembled and filled.

As best shown in FIG. 4, canister 3 is formed with passage plates 7 which extend horizontally across canister 3. Screen assemblies 10 are inserted into indentations 4 in canister 3, it being noted that passage plates 7 are placed so as to form bypass passages in alternate layers of chamical. Bottom screen assembly 15 and top screen assembly 16 are each provided with a filter 17 between the screen members, said filter comprising preferably heat-felted fiberglass. Top screen assembly 16 has one corner cut off so as to leave room for a starting candle 20 which is placed within canister 3 to rapidly provide an initial supply of oxygen.

During manufacture, the spaces between the screen assemblies 10 are filled with potassium superoxide tablets 6, which filling may be accomplished by dumping a premeasured weight or volume of the tablets into the appropriate sections of the canister. This is followed by placement of passage plates 7*a* between screen assemblies 10*a* near the top screen assemblies 10*c* and 15 nearest the bottom of canister 3 followed by the emplacement of end cap 5 in a sealing manner onto the canister. This may be accomplished by welding, soldering, gluing, or other suitable means to furnish a seal which will withstand the temperatures and pressures to be experienced in the assembly. The materials used for the end cap 5, the canister 3 and the sealing material must be non-toxic, and non-reactive with $KO_2$.

Located in the top portion of canister 3 is inlet port 22 which allows entry into the canister of exhaled breath. Exhaust hose 23 is adapted to be inserted over inlet port 22 and secured thereto, for example, by means of conventional (not shown) circular clamps or the like.

It will be seen with reference to FIG. 4 that exhaled breath coming into canister 3 through inlet port 22 first passes into a chamber 24 between the inner top wall of canister 3 and top screen assembly 16. The exhaled breath may then pass through $KO_2$ tablets 6 in the top layer and/or through the bypass passage in the top layer formed by passage plate 7. The passage plates 7 and 7*a*, in alternate layers, allow exhaled breath to pass through the chemical bed layers within canister 3 in a manner that allows maximum interaction with the $KO_2$ contained in each of the layers and at the same time provide a pressure resistance/balance which allows breath to bypass the layers, especially as the upper layers become deliquesced or diminished by reaction with exhaled breath. The inventors have found that the transverse cross-sectional areas of the bypass passages in each layer should total from 0.05 to 0.006 times the horizontal cross sectional area of the individual layer in which they are contained in order to provide an optimized resistance pressure and exhaled breath distribution. Further, the inventors have found it important that the ratio of the thickness of each of th layers in said chemical bed to the surface area of each layer facing another layer be between 0.035 and 0.055. This range of aspect ratios between thickness and surface area has been found to be optimum in providing least resistance to breath while ensuring adequate exposure of exhaled breath to reactive chemical.

Figure 2:
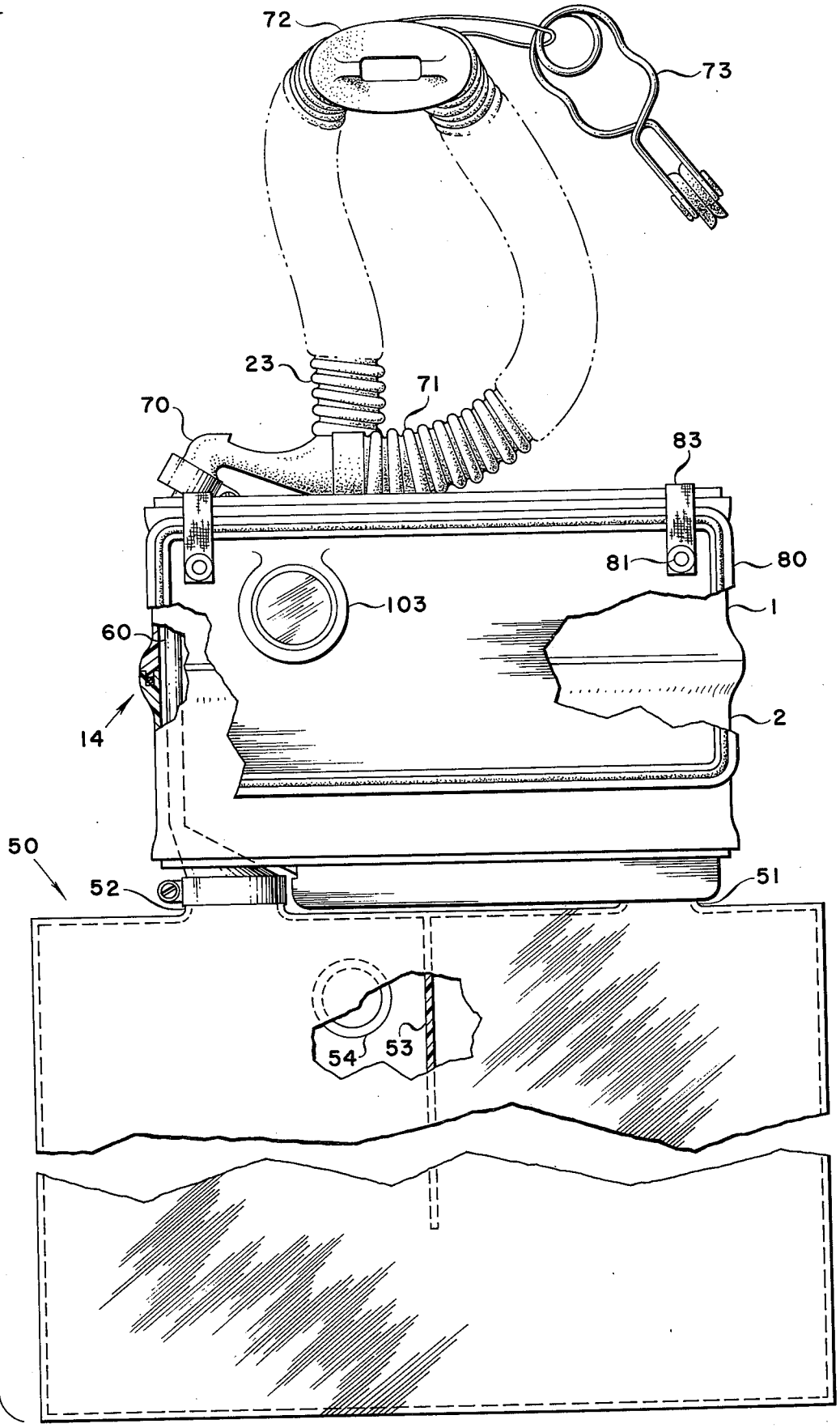
FIG. 2 is an elevation view of the personal breathing apparatus showing the mouthpiece, the main canister and case assembly, the air bag and the flow of gas therethrough.
Figure 3:
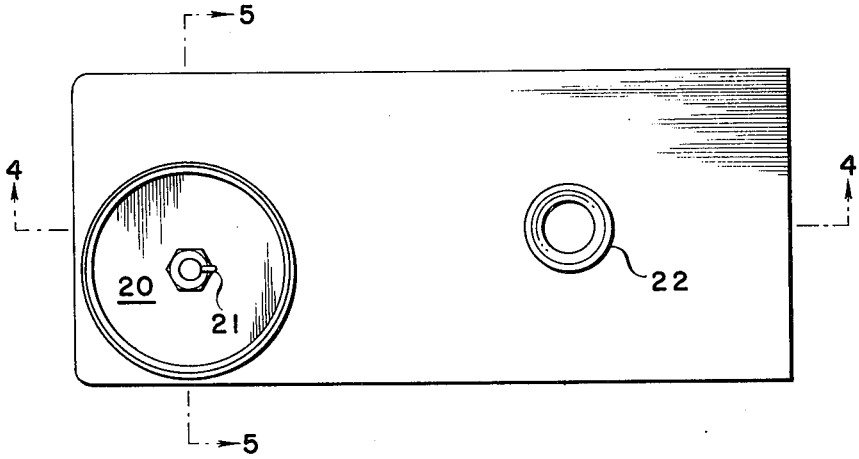
FIG. 3 is a plan view of the canister.

With reference to FIGS. 2, 4 and 5, the flow of exhaled breath through the canister assembly is shown in which breath incoming through inlet port 22 is distributed throughout the canister and proceeds to the bottom portion thereof where it encounters trammel 30 which prevents deliquesced chemical from emtering into bag 50.

In FIGS. 4, 5, 8, 9 and 10, trammel 30 is best seen to be comprised of a tubular duct member 31 which is essentially parallel to and spaced from the bottom wall 34 of canister 3 and which is supported therefrom by a tubular support 32 which interconnects one end of duct 31 with the bottom wall 34 of canister 3 which has been formed into an outlet 33.

Tubular duct 31 is preferably elliptical in cross section, the end nearest the canister wall 8 being closed, with the other end being open and truncated downwardly so as to provide an overhanging upper surface 35, the truncated open end being located near the central portion of canister 3 so as to promulgate the even flow though the canister of gases . Optimally, tubular duct 31 may be provided with an upstanding lip shown best at numeral 36 in FIG. 8 which aids in preventing the flow into the tubular duct 31 of deliquesced $KO_2$.

In cooperation with trammel 30, the bottom wall of said canister 3 is provided with a pair of angular baffle plates 40 which are generally L-shaped in cross section, with one (vertical) leg 41 being secured to the bottom wall of the canister 3 and the generally horizontal leg 42 of angular baffle plates 40 being formed in such manner as to extend generally parallel to the bottom wall while at the same time angling downwardly in such manner that the line of intersection between the vertical legs 41 and the horizontal legs 42 is closer to the tubular duct 31 than the outer edge of horizontal legs 42 with the latter being closer to the bottom wall of canister 3, thus to provide a further baffling which prevents deliquesced $KO_2$ from escaping trammel 30 and thence into the air bag 50.

Figure 8:
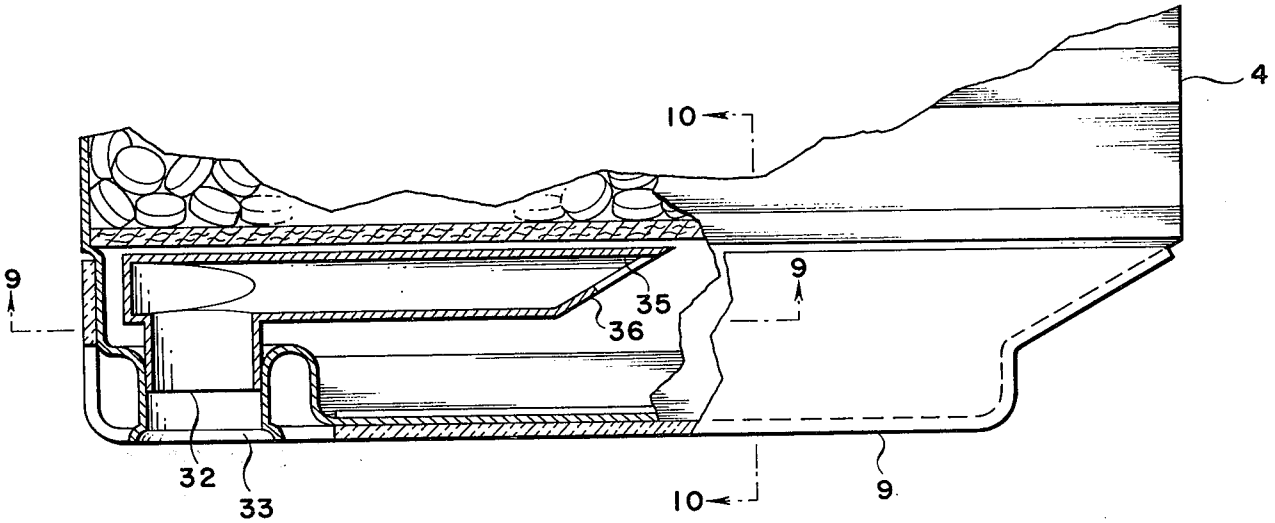
FIG. 8 is a sectional view of the lower portion of the canister showing the trammel located therein.
Figure 10:
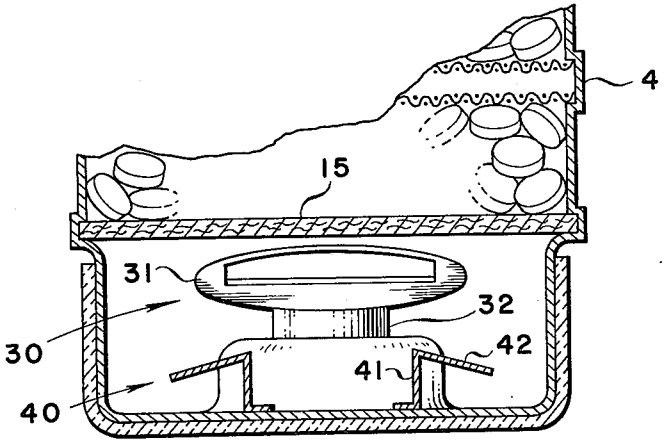
FIG. 10 is an end sectional view taken along line 10—10 of FIG. 8.
Figure 9:
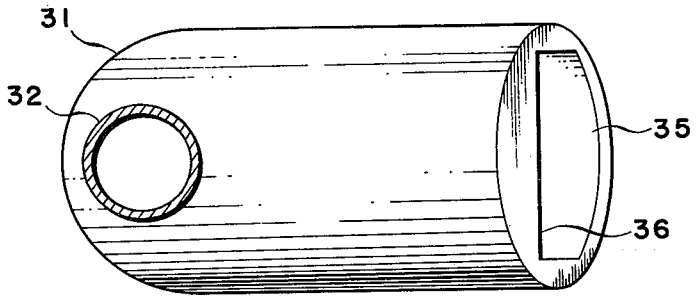
FIG. 9 is a view of the duct portion of the trammel assembly taken along line 9—9 of FIG. 8.

Since the chemical reaction of $KO_2$ with moisture from a users' breath not only generates oxygen and absorbs carbon dioxide but also generates heat, an insulator 9 is provided and indicated in FIGS. 5, 8 and 10 around the bottom of canister 3 to protect a user from coming in contact with hot metal surface of canister 3 while casings 1 and 2 provide protection from this heat on other sides of canister 3.

With reference to FIG. 2, it is seen that air bag 50 is provided with an inlet and outlet necks 51 and 52, respectively. Inlet neck 51 is adapted to be positioned over outlet 33 in canister 3 by clamping, gluing, or other sealing means. Outlet 52 of bag 50 is adapted to be clamped or sealingly engaged with the lower portion of chimney member 60. Bag 50 is provided preferably with a single baffle 53 preferably centrally located and dividing bag 50 into nearly equal volume portions with access between the portions located at a position in the bag farthest from the canister assembly. Of particular concern is the desire of the inventors to provide a path of air through the bag which will not afford added resistance, nor a particularly tortuous path, and which will be carried as far from the canister as possible over as great a length of travel as possible in order to provide a maximum cooling effect. In addition, bag 50 is provided with a relief valve 54 which vents any excess oxygen generated by the chemical 6 to the atmosphere and prevents excess pressure build up in the breather.

Bag 50 is formed of material which is essentially unreactive with potassium superoxide, at least at temperatures which might conceivably be expected to be encountered in operation of the breather. Such materials might be, for example, fluorinated ethylene propylene (TFE "Teflon") or "Kapton" as available from E. I. duPont, Wilmington, Del.

Figure 12:
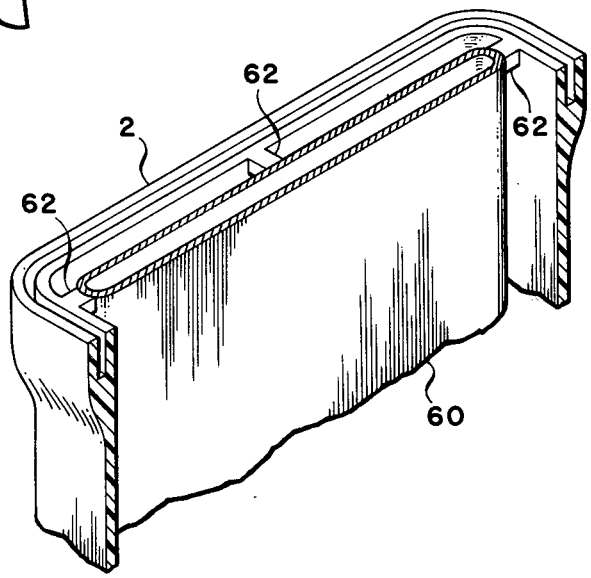
FIG.12 is an isometric view showing a portion of the casing and its passageway for containing the chimney, and the manner in which the chimney is located therein.

Referring to FIG. 12, upper and lower casings 1 and 2 and, preferably, canister 3 are provided with tabs 62 which are adapted to maintain chimney member 60 in relatively equidistant relationship with the walls of the housing and the end wall 8 of the canister 3 which walls form a passageway through the housing members 1 and 2 which allows ambient air to pass therethrough and around the chimney to furnish additional cooling by limiting contact with the relatively warm canister containing the chemical reaction affected between the $KO_2$ and a user's exhaled breath.

Figure 11:
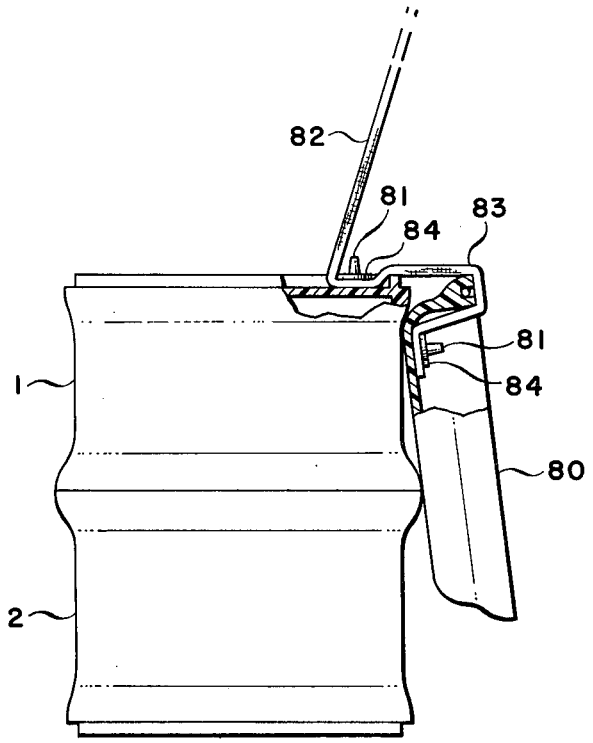
FIG. 11 is an end view of the casing showing the manner of attachment of the top cover or lid portion of the casing to the main portion of the casing.

As best shown in FIG. 1, chimney 60 is relatively flat in cross section. Chimney 60 is adapted to sealingly receive, as for example shown in FIG. 2 by transition assembly 70, the end of inlet hose 71 which is attached to mouthpiece 72. Hoses 23 and 71 are flexible hoses the ends of which are preferably "keyed" so as to prevent inlet hose 71 from being attached to mouthpiece 72 on the side which is properly adapted to receive exhaust hose 23. During periods of storage and non-use, mouthpiece 72 and hoses 23 and 71 are positioned within the cavity formed by the top wall of canister 3 and top cover 80 which is shown in FIGS. 1, 2 and 11. Top cover 80 may preferably be secured to upper casing 1 by utilization of pegs 81 (see FIG. 11) which are preferably integrally formed with members 1 and 80 and which are adapted to receive strap 82, noting that the strap 82 provides a hanging strap extending around the neck of the wearer while at the same time extending, as shown at number 83, to constitute a hinge which attaches the top cover 80 to casing 1. Top cover 80 is thus allowed to hang downwardly between the chest of the wearer and casing 1 which provides additional insulation between the wearer and the breather assembly. Straps 82 are secured to pegs 81 in any suitable manner such as by press washers 84.

Figure 13:
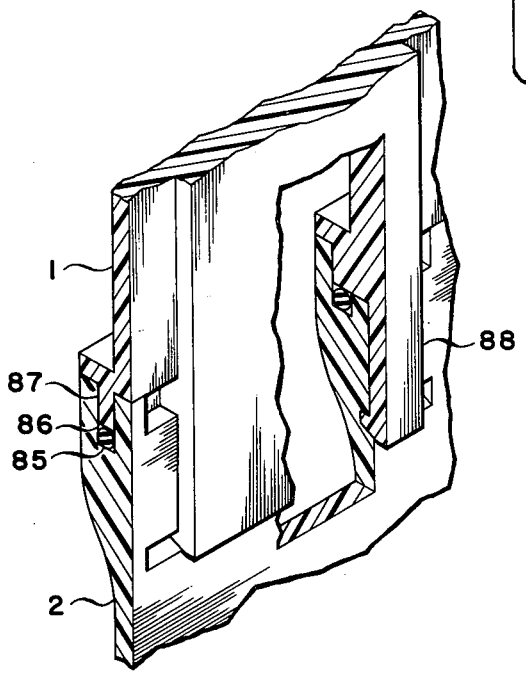
FIG. 13 is an isometric section of the area denoted by the bracket No. 13 in FIG. 2 and showing, in section, one manner of permanent attachment of the upper and lower casings housing the canister.

Casings 1 and 2 are secured one to the other by any suitable means, though the inventors have found the assembly manner shown in FIG. 13 to be particularly advantageous. In that figure, a flexible sealing ring 85 is shown positioned within channel 86 which is formed within lower casing 2. A lip 87 extending downwardly from casing 1 is adapted to be received wihin channel 86. Casings 1 and 2 are maintained in the relationship thus established by means of hooks 88 which cooperate with slots integrally formed within lower casing 2 to provide a permanent attachment of the upper to the lower casing members.

In like manner, top cover 80 is adapted to be formed with similar tongue and channel seals containing sealing rings to prevent the entry into the casing of dust, moisture, and the like. A bottom cover 90 is adapted to be attached to lower casing 2 in a manner similar to that described in connection with top cover 80.

Bottom cover 90 is adapted to contain bag 50 and chest strap 91 which is placed around the wearer's body and holds the apparatus in position regardless of the wearer's body orientation. Chest strap 91 is attached to a bottom wall section (not shown) that is provided in lower casing 2, thus providing attachment for the strap 91 between the top of bag 50 and the bottom of casing 2.

Top and bottom covers 80 and 90 secured to upper and lower casings 1 and 2, respectively, and the assembly of the breather shown in FIG. 1 is best contained in a pre-operative mode by means of a strap 100 which is provided with a quick release mechanism at 101 which is adapted to allow the bottom cap 90 to fall away as the strap is released, simultaneously allowing the top cap 80 to be opened, and the mouthpiece grasped and placed within a user's mouth, such action actuates the starting candle 20 by releasing pull pin 21 (FIG. 4) which is tied to the mouthpiece 72 and nose clip 73. Nose clip 73 is provided to close off the nose and force breathing through the mouthpiece. Starting candle 20 may be of any type suitable for use in connection with an apparatus of this type though the inventors have found that a starting candle manufactured by Life Support, Incorporated and identified as a "Breathing Unit Starter Cartridge" is particularly advantageous. This starting candle 20 actuated by pull pin 21 provides an initial supply of oxygen to "charge" canister 3 and breathing bag 50 with breathable oxygen during the short time required for the reaction between moisture in the exhaled breath of a user and $KO_2$ to commence and release sufficient quantities of usable, breathable oxygen.

An indicator shown at numeral 103 in FIG. 2 is preferably provided in top cap 80, the unit constituting a transparent window under which is mounted an indicator affected by moisture so as to change color showing, preferably within a humidity range of 5% to 10%, whether moisture has entered the internal portions of the housing formed by casings 1 and 2, top cover 80, or bottom cover 90.

While a preferred embodiment of the invention has been shown in the attached drawings, it is to be understood that equivalents are intended to be covered within the range provided in the attached claims wherein we claim:

1. In a lightweight, self-contained, personal breathing apparatus including a casing containing a canister, a plurality of parallelly disposed discrete layers of chemical constituting a bed adapted to react with the $CO^2$ and moisture in exhaled breath to produce oxygen, a mouthpiece incuding an exhalation one-way valve connected via an exhalation conduit to an input port on one side of said chemical bed, a flexible reservoir bag having an input port and an output port, an output port on the other side of said chemical bed connected to the input port of the flexible reservoir bag, a chimney juxtaposed in said casing to said canister, one end of said chimney connected to the output port of said flexible bag, the opposite end of said chimney connected to the inlet valve in said mouthpiece via an inhalation conduit, and in which said layers of chemical are separated by pairs of spaced screens spaced from the bottom wall of said canister, the improvement in which said canister is provided beneath said chemical bed with a trammel to prevent deliquesced chemical from entering into the bag, said trammel comprising a tubular duct essentially parallel to and spaced from the bottom wall of said canister and supported therefrom by a tubular support which interconnects one end of said duct with the inside of said bag, the opposite end of said duct communicating with the interior of said canister being downwardly truncated to provide an upper surface overhanging the lower, a pair of angular baffles, generally L-shaped in cross section, secured to said canister and extending generally parallel to said duct and substantially across approximately one half of the bottom of said canister, said opposite end of said duct positioned over said pair of angular baffles, one generally horizontal leg of said angular baffle positioned between the lower surface of said duct and the bottom wall of said canister.

2. A lightweight, self-contained personal breathing apparatus as claimed in claim 1 in which said generally horizontal legs slant downwardly from the center of said canister towards its side walls, and in which said tubular duct is highly eliptical in cross section.

3. A lightweight, self-contained personal breathing apparatus as claimed in claim 2 and in which the truncated open end of said tubular duct is located essentially midway between the end walls of said canister.

4. A lightweight, self-contained personal breathing apparatus as claimed in claim 1 and in which the truncated, open end of said tubular duct is located essentially midway between the end walls of said canister.

5. In a lightweight, self-contained, personal breathing apparatus including a casing containing a canister, a plurality of parallelly disposed discrete layers of chemical constituting a bed adapted to react with the $CO^2$ and moisture in exhaled breath to absorb $CO^2$ and produce oxygen, a mouthpiece including an exhalation one-way valve connected via an exhalation conduit to an input port on one side of said chemical bed, a flexible reservoir bag having an input port and an output port, an output port on the other side of said chemical bed connected to the input port of the flexible reservoir bag, a chimney juxtaposed in said casing to said canister, one end of said chimney connected to the output port of said flexible bag, the opposite end of said chimney connected to the inlet valve in said mouthpiece via an inhalation conduit, and in which said layers of chemical are separated by pairs of spaced screens spaced from the bottom wall of said canister, the improvement in which each of said layers of chemical contains at least one by-pass passage, the transverse cross-sectional areas of the by-pass passages in each layer totalling an area from 0.05 to 0.006 times the horizontal cross sectional area of an individual layer, said by-pass passages being separated from the layers of chemical in which they are situate by substantially impervious material.

6. A lightweight, self-contained personal breathing apparatus as claimed in claim 5 in which the mesh size of said screens is from approximately $6 \times 6$ to $10 \times 10$ or equivalent.

7. A lightweight, self-contained personal breathing apparatus as claimed in claim 6 in which the layers constituting said chemical bed are filled with potassium superoxide ($KO_2$) in tablet form, a plurality of small spacing tabs on the inner surface of said casing, said chimney being secured in place within said canister by said tabs, thus affording an annular channel surrounding said chimney facilitating the flow of cooling, ambient, air around said chimney member,

8. A lightweight, self-contained personal breathing apparatus as claimed in claim 7 in which said bag is formed of a material which is essentially nonreactive with potassium superoxide and in which said bag is provided with a single baffle sealingly attached to the inner surface of said bag thus separating said bag into two separate compartments, a passage in said baffle interconnecting said compartments located at that portion of the bag farthest from the inlet and outlet ports, thus forcing gas entering the bag to follow a path which would afford maximum temperature reducing capability as it passed through the bag.

9. In a lightweight, self-contained personal breathing apparatus including a casing containing a canister, a plurality of parallelly disposed dicrete layers of a chemical constituting a bed adapted to react with the $CO^2$ and moisture in exhaled breath, a mouthpiece including an exhalation one way valve connected via an exhalation conduit to an input port on one side of said chemical bed, a flexible reservoir bag having an input port and an output port, an output port on the other side of said chemical bed connected to the input port of the flexible reservoir bag, a chimney juxtaposed in said casing to said canister, one end of said chimney connected to the output port of said flexible bag, the opposite end of said chimney connected to the inlet valve in said mouthpiece via an inhalation conduit, and in which said layers of chemical are separated by pairs of spaced screens spaced from the bottom wall of said canister, the improvement in which said canister is provided beneath said chemical bed with a trammel to prevent deliquesced chemical from entering into the bag, said trammel comprising a tubular duct essentially parallel to and spaced from the bottom wall of said canister and supporting therefrom by a tubular support which interconnects one end of said duct with the inside of said bag, the opposite end of said duct communicating with the interior of said canister being downwardly truncated to provide an upper surface overhanging the lower, a pair of angular baffles, generally L-shaped in cross section, secured to said canister and extending generally parallel to said duct and substantially across the bottom of said canister, said opposite end of said duct positioned over said pair of angular baffles, one generally horizontal leg of said angular baffle positioned between the lower surface of said duct and the bottom wall of said canister, said generally horizontal leg downwardly slanting from the center of said canister toward its side walls, said tubular duct being highly eliptical in cross section, and the truncated, open end of said tubular duct located essentially midway between the end walls of said canister, a plurality of by-pass passageways located in each of the layers of said chemical bed, the transverse cross-sectional area of said by-pass passages in each layer totalling an area from approximately 0.05 to approximately 0.006 times the horizontal cross section of the individual layer, said by-pass channels being separated from the layers of chemical in which they are situate by substantially impervious material, said by-pass passages being located in alternate ends of the chemical layers in which they are situate.

10. A lightweight, self-contained personal breathing apparatus as claimed in claim 9 in which the chemical in said bed consists of potassium superoxide in tablet form, said tablets being of a size range of approximately 7 millimeters in diameter by 3 mm thick to approximately 10 millimeters in diameter by 5 mm thick, the ratio of the thickness of each of the layers in said chemical bed to the surface area of each layer facing another layer being between 0.035 and 0.055.

11. A lightweight, self-contained personal breathing apparatus comprising a case, said case being comprised of two center sections adapted to be sealingly joined along one edge, an inter-registering chimney passageway open to ambient air extending through said center sections along one end wall, the remaining area surrounded by the joined sections constituting a large cavity, a canister having inlet and outlet ports therein positioned within said cavity, a plurality of pairs of spaced screens within said canister, said screens being positioned so as to provide a transverse flow of gas between said inlet and said outlet ports in said canister, potassium superoxide in tablet form essentially filling the areas between said spaced screens and constituting a plurality of discrete, parallelly disposed, layers of chemical separated by the spacing between said pairs of screens, said canister end walls being provided with by-pass passages inter-connecting the spaces between said pairs of screens, said by-pass passages being located essentially on alternately opposite ends of said chemical bed layers, the space between said pairs of screens nearest the inlet and outlet ports being provided with a filter between said pairs of screens, said chemical layer nearest the inlet port in said canister being shortened thus providing a space for receiving a starting candle for providing a quick initial charging supply of oxygen, the portion of the canister near the outlet port thereof defining a space wherein a trammel assemby is situate, said trammel assemby comprising a tubular duct member, highly eliptical in cross-section, with the flatter axis positioned approximately parallel to the closest pair of screens, said eliptical duct spaced from the bottom wall of said canister and supported thereform by a tubular member constituting the outlet port in said canister, which outlet port intercommunicates with the internal passage in said duct member, the input end of the duct forming a portion of the trammel being situate essentially midway between the end walls of said canister and being truncated in such manner that the upper portion of said duct provides an overhang over the lower portion thereof, angular, essentially L-shaped in cross section, baffle plates with one leg upstanding from the bottom of said canister and the other extending generally parallel to the duct member, the line of intersection of the legs of said angular baffle being located farther from the bottom wall of said canister than the outer edge of the other angular component thereof, the input end of said duct positioned over said pair of angular baffles, the aspect ratio between the thickness of the chemical bed layers in said canister and the surface area interfacing between the respective layers being between approximately 0.035 and 0.055, the size of said $KO_2$ tablets being in a range of approximately 7 millimeters in diameter by 3 mm thick to 10 millimeters in diameter by 5 mm thick, the bottom cap member adapted to be sealingly connected to the lower edge of one of said casing members, said cap containing a breathing bag composed of material essentially non-reactive with $KO_2$, and being provided with an inlet and an outlet port, the inlet port in said bag being attached to the outlet port in said canister and the outlet port of said bag connected to a chimney inserted into the chimney cavity in said casing, a single baffle separating said bag essentially into two portions and forcing gas entering the bag to travel to the side of the bag opposite the inlet port prior to accessing the other compartment of the bag, thus affording a maximum cooling path for gases entering the bag, a top cap adapted to be sealingly secured to the upper edge of the upper of said two center casing members, said top cap containing a breather valve including a one-way exhalation valve, and a one-way inhalation valve, said one way exhalation valve being connected by a flexible hose to the inlet port in said canister, and said one way inhalation valve being connected by flexible hose to the other end of said chimney, a securing strap surrounding said casing, including the top and bottom end caps and a quick release mechanism adapting said strap for quick release in the event of emergency, whereupon the end caps are released allowing immediate access to said mouthpiece and allowing said breathing bag to expand with gas to operational capacity.

* * * * *